US006483479B1

(12) United States Patent
Lin et al.

(10) Patent No.: US 6,483,479 B1
(45) Date of Patent: Nov. 19, 2002

(54) INSTANTLY WELDED ANTENNA AND ITS METHOD OF WELDING

(75) Inventors: Jammy Lin, Tuu-Cheng (TW); Ping Kun Wu, Tao-Yuan (TW)

(73) Assignee: Auden Techno Corp., Taoyuan Hsien (TW)

( * ) Notice: Subject to any disclaimer, the term of this patent is extended or adjusted under 35 U.S.C. 154(b) by 0 days.

(21) Appl. No.: 09/940,444

(22) Filed: Aug. 29, 2001

(51) Int. Cl.[7] ..... H01Q 1/36; H01Q 1/24
(52) U.S. Cl. ..... 343/895; 343/702
(58) Field of Search ..... 343/895, 702

(56) References Cited

U.S. PATENT DOCUMENTS 6,191,755 B1 * 2/2001 Hamaaratsu ..... 343/895
6,262,693 B1 * 7/2001 Sutter et al. ..... 343/895
6,320,557 B1 * 11/2001 Chiang ..... 343/895
6,359,598 B1 * 3/2002 Sullivan ..... 343/895

* cited by examiner

*Primary Examiner*—Don Wong
*Assistant Examiner*—Hoang Nguyen
(74) *Attorney, Agent, or Firm*—Troxell Law Office PLLC

(57) ABSTRACT

An instantly welded antenna of which a helical coil is positioned on an end face of a metallic seat member thereof; the metallic seat member and the helical coil are put into a matched inner blind hole of a plastic insulating sleeve. A heated surface provided on the metallic seat member can be heated instantly. The peripheral surface of the metallic seat member and the inside surface of the matched inner blind hole of the insulating sleeve is used as a heat conductive welding surface to weld the metallic seat member and the insulating sleeve, and the helical coil is positioned therein. Thus, the core diameter, the pitch and the overall length of the helix coil can be maintained, not only the inferiority of products is lowered, but also the processing efficiency of the products is increased.

13 Claims, 3 Drawing Sheets

INSTANTLY WELDED ANTENNA AND ITS METHOD OF WELDING

BACKGROUND OF THE INVENTION

1. Field of the Invention

The present invention is related to an instantly welded antenna; and especially to such an antenna for a mobile phone, which antenna is suitable to be welded at the end thereof having a metallic seat member with superior heat conductivity to generate high temperature to partially melt an insulating plastic sleeve so as to instantly form a structure with a strong engaging force.

2. Description of the Prior Art

A helix coil formed by winding a metallic wire is the main element for transmitting and receiving frequency on an antenna. The structure of the helix antenna affects the function of the whole antenna in every aspect. The helix antenna as disclosed in British Patent No.2, 206,243 of which the diameter of wire of the coil, the material of the coil such as one made from copper plated steel, the core diameter, the pitch and the overall length of the helix coil etc. all affect its proper and set function.

Moreover, sometimes a mobile phone used nowadays have more than one frequency, such as two frequencies of 900 KHz and 1800 KHz, so it surely can be made to have a dual-frequency antenna by various methods and with various structures. The dual-frequency helical antenna of the British Patent No.2, 260,243 as mentioned above was made from a long helical coil and a linear conductor extended into the long helix coil. Among the modern designs of coils, even a single coil with sections of different density can form a dual-frequency antenna. No matter what kind of design of structure is adopted for the coil antenna for transmitting and receiving frequencies, to maintain the predetermined diameter, the pitch of the helix and the overall length of the coil antenna after production becomes quite important.

But among the processing methods for the presently available coil antennas, the most usually used method is to mount one end of the coil on the surface of the metallic seat member, then put it immediately into a mold to proceed to shaping by enveloping. The conventional method is not only inconvenient in processing, but also slow in production speed. The metallic seat member and the coil are put together in the mold to proceed to ejection enveloping of the insulating sleeve. The structure of the coil is hollow and spiral; this can easily affect the predetermined diameter of the coil, the pitch and the overall length of the helix coil. Rate of inferiority of the products thus becomes rather high under examination. This not only wastes working hours and material, but also increases the total cost of production indirectly.

SUMMARY OF THE INVENTION

The object of the present invention is to provide an instantly welded antenna of which a metallic seat member of the coil is made of better heat-conductive material such as copper family material, and an insulating sleeve is mainly made of the plastic family material. After assembling and positioning of the metallic seat member, the coil and the insulating sleeve as mentioned above, one end of the metallic seat member is heated up instantly; The heated surface can conduct heat to a welding surface formed at the peripheral surface of the metallic seat member and the relative inside surface of the insulating sleeve to generate a strong engaging and welding effect. Thus the production process will become more convenient and rapid; besides, the predetermined diameter of the coil, the pitch and the overall length of the helix coil can be maintained more effectively to lower the inferiority of the products.

The closer the distance between the heated surface and the welding surface as mentioned above is, the more suitable the shortening time of welding will be.

In principle, the above mentioned heated surface must be positioned slightly above the connecting position of the metallic seat member and the insulating sleeve to prevent deforming or damaging of the plastic insulating sleeve.

The above mentioned insulating sleeve can be made of engineering plastic of a mixture of plastic and rubber family material or of other family material, whereof, the ratio of the plastic family is most preferably more than 40%.

The heat-up temperature of the abovementioned metallic seat member and plastic insulating sleeve had better be 200° C.–250° C., and it is most preferred to give the metallic seat member pressurizing with a set stroke.

In a preferred embodiment, the metallic seat member provides a shoulder portion thereof as the heated surface, and the peripheral surface thereof used as a welding and connecting surface extends with a predetermined length thereof into a relatively inside stepped-hole portion of the insulating sleeve. Then the heated surface is heated up instantly and welding is engaged in under the pressurizing with a set stroke.

The present invention will be apparent in its novelty and other features after reading the detailed description of the preferred embodiment thereof in reference to the accompanying drawings.

DETAILED DESCRIPTION OF THE PREFERRED EMBODIMENT

Figure 1:
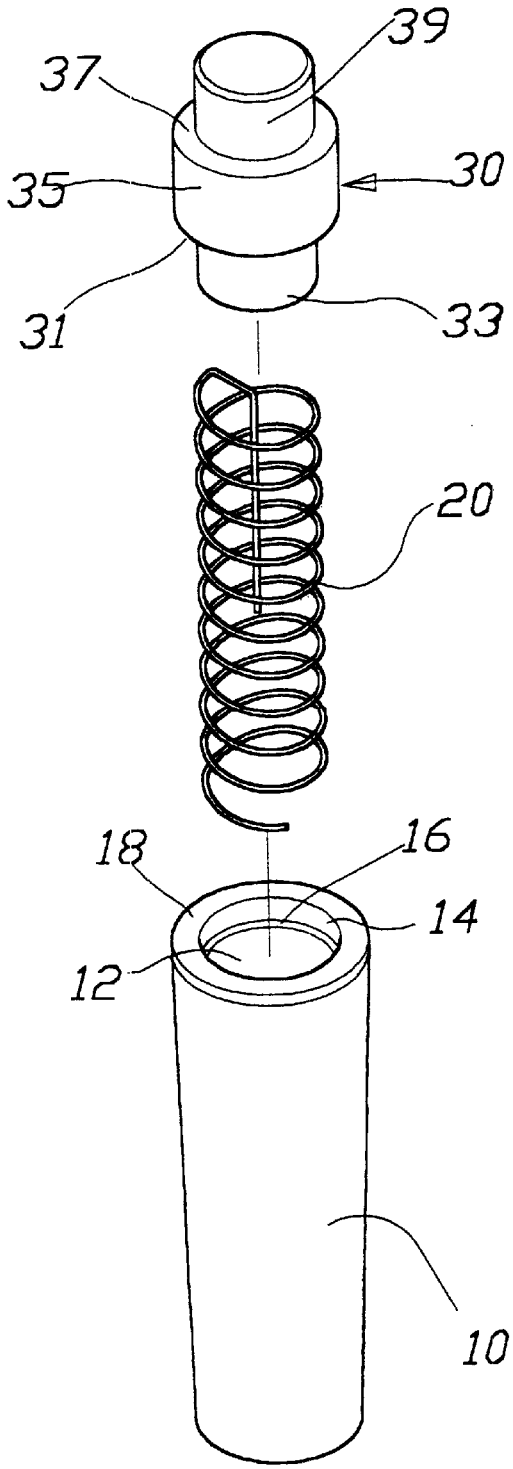
FIG. 1 is an analytic perspective view showing the main elements prior to the assembling process of the preferred embodiment of the present invention.

Referring to FIG. 1 firstly, the main elements of the end of a fixed or movable style (such as flexible style) antenna include an insulating sleeve 10, a helical coil 20 and a metallic-seating member 30.

The insulating sleeve 10 is mainly made of plastic family material, but it can also be made of engineering plastic, which is a mixture of plastic and rubber family material or of other suitable material. While using the mixed engineering plastic, the ratio of the plastic family is most preferably more than 40%. In the embodiment as shown in FIG. 1, the insulating sleeve 10 is providing with an inner blind hole 12 with proper depth and diameter. A small section of an enlarged hole portion 14 is formed close to the opening of the insulating sleeve 10 to form a stepped portion 16 between the blind hole 12 and the enlarged hole portion 14. A helical coil 20 can be installed into the inner blind hole 12 of the insulating sleeve 10; then the metallic seat member is assembled on the enlarged hole portion 14 with proper tightness.

Figure 2:
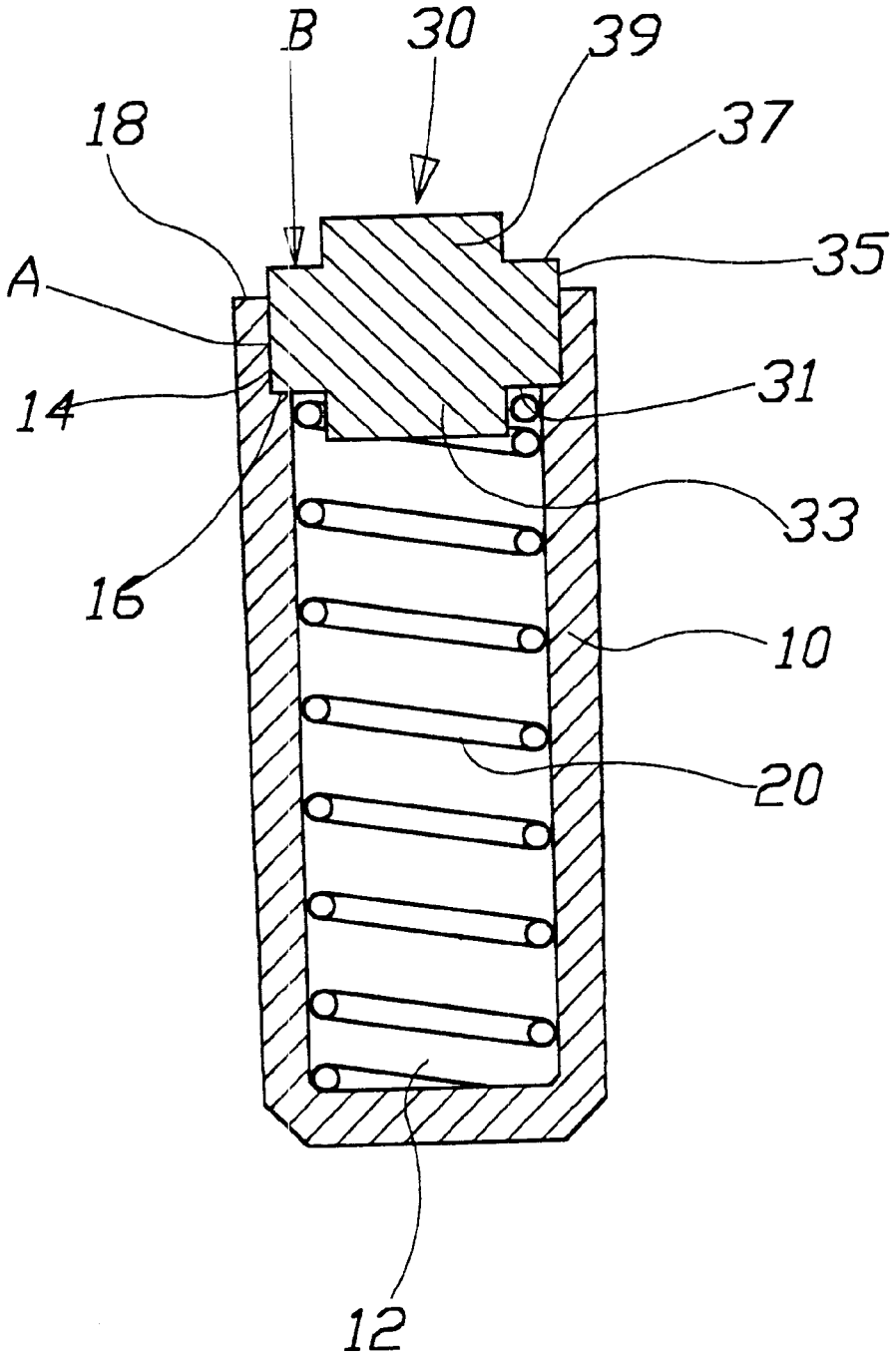
FIG. 2 is a sectional view showing the elements as shown in FIG. 1 at the initiative of assembling.

As shown in FIGS. 1 and 2, the metallic seat member 30 can be made of any heat-conductive metal, but in consideration of the electric conductibility, the copper family material is most ideal. Although the assembling work of the present invention can be done by just connecting the metallic seat member 30 with the insulating sleeve 10 with proper tightness, but in the preferred embodiment as shown in the drawing, the metallic seat member 30 includes a central stub 33 at its lower end face 31, a peripheral surface 35 of predetermined diameter and length in matching with the inner hole of the insulating sleeve 10, and a stub with a smaller diameter 39 at its upper end face 37 to form a shoulder portion on the other end. When in starting assembling of the metallic seat member 30 made according to the preferred embodiment as shown in FIG. 2, the peripheral surface 35 is inserted and connected with the enlarged hole portion 14 of the insulating sleeve 10 with proper tightness. The end face 31 is pressed down against the stepped portion 16 of the insulating sleeve 10. Since the length of the peripheral surface 35 is set to be slightly longer than that of the enlarged hole portion 14; the upper end face 37 is slightly higher than the end face 18 of the insulating sleeve 10 under this assembling condition.

For the convenience of the explanation of the following processing procedure, the joint of the peripheral surface 35 of the abovementioned metallic seat member 30 and the enlarged hole portion 14 of the insulating sleeve 10 will be called a "welding surface A". And the shoulder formed by the metallic seat member 30 and the upper end face 37 will be called a "heated surface B".

While implementing the welding process of the present invention, it is preferred to get the heated surface B and the welding surface A as close to each other as possible. In the structure of the abovementioned embodiment, since the shoulder formed by the upper end face 37 of the metallic seat member is very close to the peripheral surface 35, this area forms the very ideal heated surface B. The heated surface B not only has the advantage of conducting heat easily due to the short distance, but also can shorten welding time and speed up the production process.

A heat source (not shown) can be pressed against the heated surface B to conduct instant heating. By using the insulating sleeve 10 of plastic material and the metallic seat member 30 of copper material, the practicable embodiment is heated instantly for 2–3 seconds at 200° C.–250° C. The peripheral surface 35 of the metallic seat member 30 and the matched inner blind hole of the insulating sleeve 10 will generate a welding effect to engage each other forcefully.

It is necessary to position the heated surface B slightly above the joint of the metallic seat member 30 and the insulating sleeve 10 to proceed to the heating process. This can prevent deforming and damaging of the insulating sleeve 10 effectively.

Figure 3:
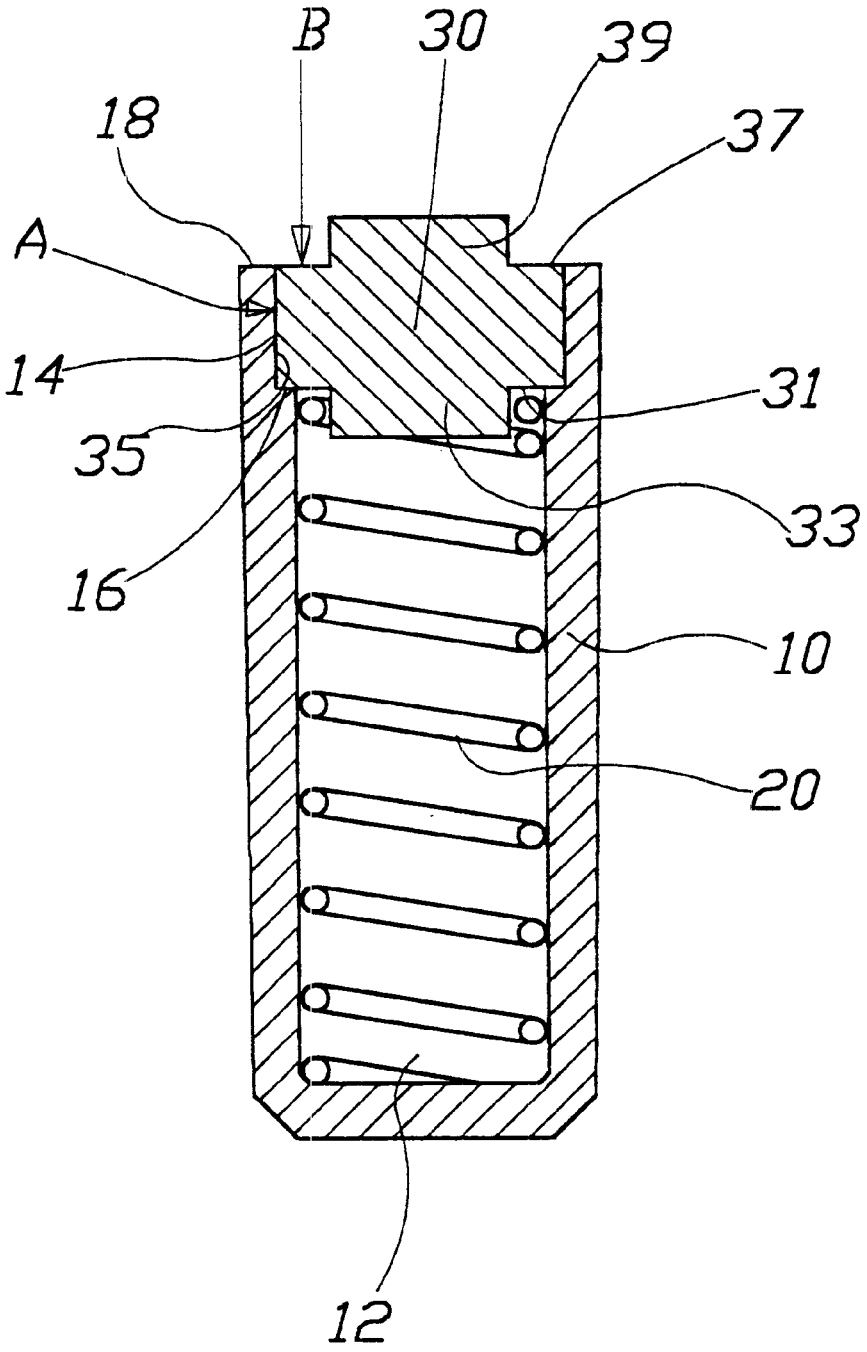
FIG. 3 is a sectional view showing the state after the assembling and positioning work of FIG. 2.

In the preferred embodiment as shown in FIGS. 2 and 3, in proceeding to the instant heating-up, pressurizing with a set stroke is given, the entire metallic seat member 30 will be instantly welded and extend into the interior of the insulating sleeve 10. It is most preferred to let the shoulder portion of the metallic seat member 30 be flush with the end face 18 of the insulating sleeve 10 after it is completely positioned. In coordination with this processing step, the depth of the inner blind hole of the insulating sleeve 10 can be preset to be a little longer than the length of the helical coil 20 in the normal state.

In this processing method of the present invention, since the instant welding process in assembling and positioning of the helical coil can be accomplished nearly without being affected by the processing, the originally predetermined diameter of the coil, the pitch and the overall length of the helix coil can be maintained. The rate of inferiority that can be caused by the conventional processing method can be lowered greatly hereby, the product quality will then be more stable and reliable, and production can run faster and more conveniently when it is done in the mode of mass production.

The above stated preferred embodiment is only for illustrating the present invention. It will be apparent to those skilled in this art that various modifications or changes can be made to the present invention. And all such modifications and changes also fall within the scope of the appended claims and are intended to form part of this invention.

What is claimed is:

1. A method of processing instant welding of an antenna, said method comprises:

providing a metallic seat member including at least a heated surface;

a helical coil being positioned at the initiative of assembling on a lower end face of said metallic seat member;

said metallic seat member and said helical coil assembled at the initiative of assembling being installed in a matched hole of a plastic insulating sleeve;

said heated surface formed by the upper end face of said metallic seat member being heated up instantly, and the peripheral surface of said metallic seat member being used as a heat conductive welding surface to weld said metallic seat member to said insulating sleeve and to position said helical coil therein.

2. A method of processing instant welding of an antenna as claimed in claim 1, wherein, said heated surface is positioned close to said welding surface.

3. A method of processing instant welding of an antenna as claimed in claim 1, wherein, said heated surface is positioned slightly above the joint of said metallic seat member and said insulating sleeve.

4. A method of processing instant welding of an antenna as claimed in claim 3, wherein, said heated surface is pressurized in a set stroke, and is flush with said end face of said insulating sleeve.

5. A method of processing instant welding of an antenna as claimed in claim 1, wherein, said metallic seat member is made of copper family material.

6. A method of processing instant welding of an antenna as claimed in claim 1, wherein, said plastic insulating sleeve is made of mixed engineering plastic from plastic and rubber material.

7. A method of processing instant welding of an antenna as claimed in claim 6, wherein, the ratio of said plastic material is more than 40% of said mixed engineering plastic.

8. A method of processing instant welding of an antenna as claimed in claim 1, wherein, the instant heating-temperature for said heated surface is 200° C.–250° C. and the heating time for said heated surface is 2–3 seconds.

9. An instantly welded antenna, said antenna comprises:

a metallic seat member with a central stub at its lower end face and with a peripheral surface of predetermined diameter and length, a stub with a smaller diameter provided at the other upper end face thereon forming a shoulder used as a heated surface for instant heating;

a helical coil of predetermined core diameter, pitch and overall length being positioned on said central stub of said metallic seat member; and a plastic insulating sleeve with an inner blind hole of which the depth is slightly larger than the length of said helical coil for installing said helical coil therein, and for inserting and connecting said peripheral surface of said metallic seat member into an enlarged hole portion on the upper end of said plastic insulating sleeve; the joint of said peripheral surface and said enlarged hole portion functioning as a heat conductive welding surface.

10. An instantly welded antenna as claimed in claim 9, wherein, said metallic seat member is made of copper family material.

11. An instantly welded antenna as claimed in claim 9, wherein, said plastic insulating sleeve can be made of mixed engineering plastic from plastic and rubber material.

12. An instantly welded antenna as claimed in claim 11, wherein, the ratio of said plastic material is more than 40% of said mixed engineering plastic.

13. An instantly welded antenna as claimed in claim 9, wherein, the instant heating-temperature for said heated surface is 200° C.–250° C., the heating time for said heated surface is 2–3 seconds.

* * * * *